US006777618B2

(12) United States Patent
Bond et al.

(10) Patent No.: US 6,777,618 B2
(45) Date of Patent: Aug. 17, 2004

(54) CABLE IDENTIFICATION AND CABLE MANAGEMENT SLIDING DEVICE

(75) Inventors: Matthew R. Bond, Ashland, OR (US); Garry V. Lambert, Talent, OR (US)

(73) Assignee: Tara Labs, Inc., Ashland, OR (US)

( * ) Notice: Subject to any disclaimer, the term of this patent is extended or adjusted under 35 U.S.C. 154(b) by 0 days.

(21) Appl. No.: 10/198,648

(22) Filed: Jul. 17, 2002

(65) Prior Publication Data

US 2003/0017742 A1 Jan. 23, 2003

Related U.S. Application Data

(60) Provisional application No. 60/306,266, filed on Jul. 17, 2001.

(51) Int. Cl.[7] ..... H01B 7/36
(52) U.S. Cl. ..... 174/112
(58) Field of Search ..... 174/112, 77 R, 174/92

(56) References Cited

U.S. PATENT DOCUMENTS

| | | | | |
|---|---|---|---|---|
| 4,282,397 A | * | 8/1981 | Siedenburg et al. | 174/92 |
| 4,490,422 A | | 12/1984 | Pascher | |
| 4,643,505 A | | 2/1987 | House et al. | |

FOREIGN PATENT DOCUMENTS

| | | | |
|---|---|---|---|
| DE | 40 08 229 | * | 5/1991 |
| EP | 0392157 | | 10/1990 |
| EP | 439 940 | * | 8/1991 |
| EP | 0439940 | | 8/1991 |
| GB | 2 241 388 | * | 8/1991 |
| JP | 4-26012 | * | 1/1992 |
| WO | WO 93/04489 | * | 3/1993 |

OTHER PUBLICATIONS

International Search Report, WO 03/009516, completed Jan. 10, 2003.

* cited by examiner

*Primary Examiner*—Chau N. Nguyen
(74) *Attorney, Agent, or Firm*—Kolisch Hartwell, P.C.

(57) ABSTRACT

A sliding device to identify and trace interconnect cable includes a directional indicator to indicate a user-identified cable orientation, a predefined labeling area for receiving a user-applied identifier, and an interior passageway for receiving a cable. A cable is traced by sliding the device along the cable. The device may have an interlock mechanism, in which a clip portion on one device interlocks with a flange portion on an adjacent device, to attach sliding devices together in parallel to organize clearly and identify multiple cables. The device may be assembled from multiple component parts that fit and connect together around a cable.

39 Claims, 3 Drawing Sheets

CABLE IDENTIFICATION AND CABLE MANAGEMENT SLIDING DEVICE

CROSS-REFERENCE TO RELATED APPLICATIONS

The present application claims priority from Provisional Patent application Serial No. 60/306,266, filed Jul. 17, 2001, which is hereby incorporated by reference in its entirety for all purposes.

BACKGROUND OF THE INVENTION

The present invention relates generally to a sliding device attached to audio, video, or digital cable connected between components in an audio, audio/video, or video system.

SUMMARY OF THE INVENTION

In modern audio, audio/video and video equipment, a large number of component connections are possible. This results in a large number of interconnect cables being installed in a relatively small and usually cramped area, especially with home entertainment systems. Tracing interconnect cables from input to output has become increasingly difficult. Identifying and organizing these interconnect cables also can be challenging.

One solution is to attach one or more labels or tags to each cable, either to identify which components are connected by the cable, or to indicate signal flow. However, this approach is unsatisfactory because cables remain in disarray. On the other hand, currently available methods to minimize the clutter of multiple cables, for example, by intertwining or by threading multiple cables through a sleeve or flexible tube, frustrates the user's ability to easily determine the identity and/or signal direction flow of a specific cable among a collection of cables. Therefore, it is desirable to have a device that simultaneously identifies and organizes interconnect cables. Accordingly, an object of the present invention is to organize multiple cables in such a way that individual cables may be identified easily.

Moreover, in component arrangements in a limited space, indicating signal flow by means of an attached label may be ineffective if a user must make such a determination solely by feel. Therefore, another object of the present invention is to indicate signal flow of a cable by means of the shape of the device, or by means of embossing the surface of the device, such that a user may determine signal flow solely by sense of touch.

Attached labels or tags are also used to indicate the identity and/or use of the cable. However, such labels or tags inadvertently may peel off or become detached through repeated use or by rubbing against adjacent cables. On the other hand, permanently affixing such labels to a cable limits its use if, for example, a user desires to use the same cable to connect different components at another time. Labels permanently affixed to a specific portion of a cable also hinder a user's ability to trace a cable from input to output. Therefore, it is desirable to have a secure identifying device that is selectively detachable, and that also slides relatively freely along the cable, allowing a user to trace the cable from input to output.

The invention provides a method to identify, organize, and trace interconnect cables from one audio/video component to another by means of a connectible sliding device.

The advantages of the present invention will be understood more readily after a consideration of the drawings and the Detailed Description of the Preferred Embodiment.

DETAILED DESCRIPTION OF THE PREFERRED EMBODIMENT

Figure 1:
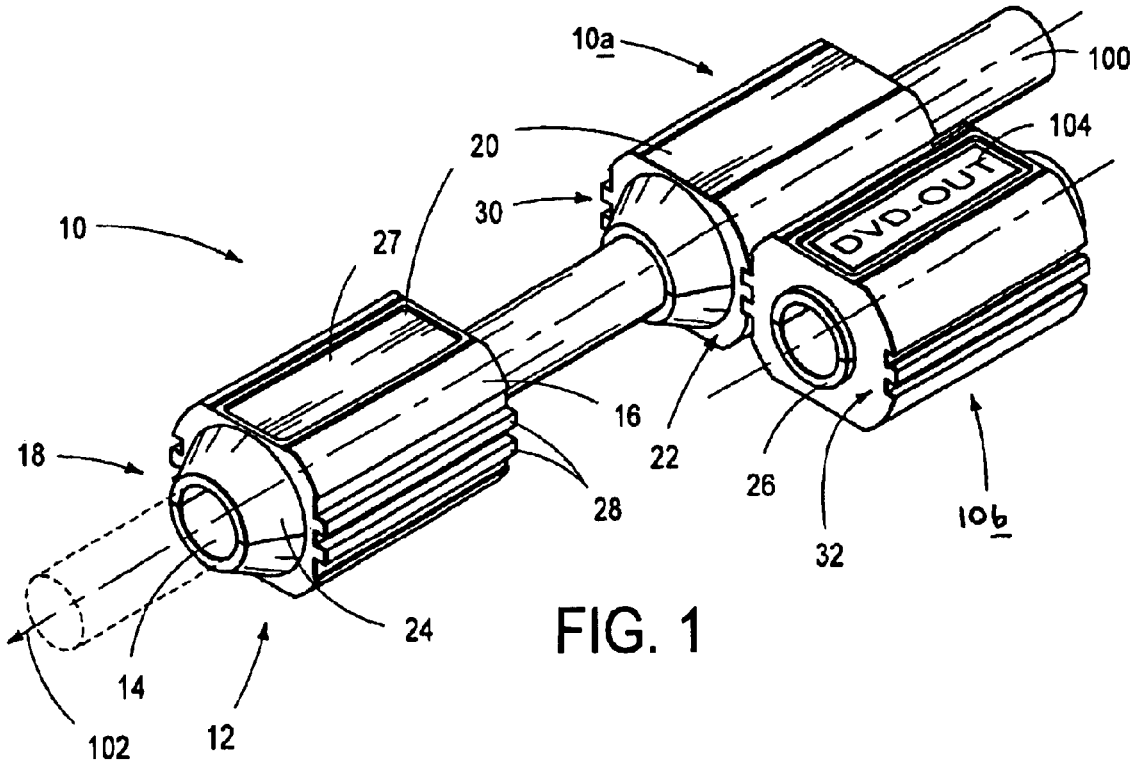
FIG. 1 is an isometric view of three sliding devices according to one embodiment of this invention, depicting the devices in position on an interconnect cable.

Referring to the drawings, specifically to FIG. 1, several sliding devices according to one embodiment of the present invention are shown, one of which is a sliding device 10. Sliding device 10 includes a body 12, which defines an interior passageway 14 and an exterior 16. Interior passageway 14 accommodates an interconnect cable, indicated at 100, such that sliding device 10 may be secured movably on interconnect cable 100.

Exterior 16 includes a directional indicator 18, flat area 20, and interlock mechanism 22. Directional indicator 18 may be used to indicate direction of signal flow 102 within interconnect cable 100, or alternately may indicate a direction from output to input or cable direction according to the user. In FIG. 1, directional indicator 18 is a tapered end 24 of sliding device 10. Device 10 features flat end 26 opposite tapered end 24, clarifying that tapered end 24 indicates the cable direction.

Flat area 20 may include a recessed area 27 to accommodate label 104 or any such user-applied identifier to designate cable usage. Alternatively, flat area 20 may form a useful surface upon which to grip sliding device 10, for instance between thumb and forefinger, to slide it along the cable.

Figure 2:
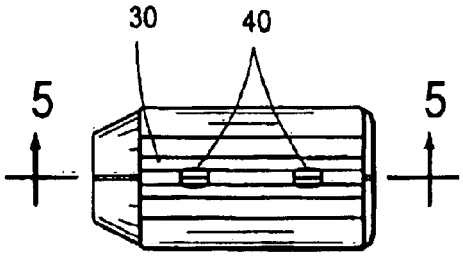
FIG. 2 is a side view of a sliding device of FIG. 1.
Figure 3:
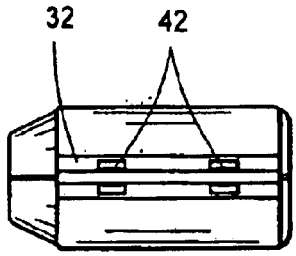
FIG. 3 is a side view of an opposite side of the sliding device of FIG. 2.
Figure 4:
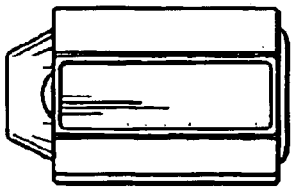
FIG. 4 is a top view of the sliding device of FIG. 2.

Interlock mechanism 22 is used securely to attach multiple sliding devices together in parallel, by means of ridges 28 running the length of the sliding device. Interlock mechanism 22 is defined collectively by a clip 30 and a flange 32. Clip 30 consists of two parallel ridges on one side of a sliding device. Flange 32 consists of a single ridge on the opposite side of a sliding device. As shown in FIG. 1, clip 30 on sliding device 10*a* fits within flange 32 on adjacent sliding device 10*b* to form an interference fit, securing the adjacent devices 10*a* and 10*b* against each other. To strengthen the interference fit, clip 30 may include indents 40 (FIG. 2), and flange 32 may include corresponding fins 42 (FIG. 3), such that when flange 32 is fitted within clip 30, fins 42 engage corresponding indents 40 to lock adjacent sliding devices together and prevent lateral shifting of the adjacent devices relative to each other.

Utilizing the interlock mechanism, several sliding devices may be interlocked in parallel, to organize clearly and identify multiple cables. This arrangement allows a user to maintain a complicated set of cables, or to change individual cable use, with relative ease. A user may detach a single sliding device from an interlocked series, slide it along a cable to identify or verify the cable's use, and then either re-attach it to the interlocked series or make changes as desired. The organization may be improved further by interlocking several sliding devices at multiple points along parallel cables.

Figure 5:
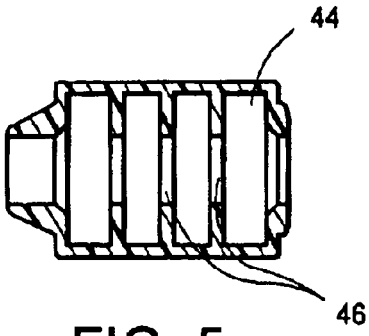
FIG. 5 is a cross-sectional view of the sliding device of FIG. 2, taken along line 5—5 of FIG. 2.

Interior passageway 14 may include restraining means to increase the grip of the sliding device on the interconnect cable. For example, FIG. 5 depicts a cross-sectional view of a sliding device including interior wall 44 which features inner ribs 46. Alternatively, the restraining means may consist of a rib-like structure to accommodate a tight-fitting O-ring, to limit free movement of sliding device 10 along cable 100. Of course, the restraining means may be varied in size and shape, or omitted entirely, to decrease the grip of the sliding device on the cable. In this case, sliding device 10 may fit loosely around cable 100 such that the device can move relatively freely along the cable, coming to rest at a position dictated by gravity. It should be understood that this disclosure includes all means to increase or decrease the grip of the device on an interconnect cable.

Sliding device 10 may be molded in one piece, in which case a device must be placed on an interconnect cable before attaching the cable to components. Alternatively, the device may assembled from multiple component parts. A composite device may be affixed to a cable already in use, by fitting and connecting the component parts to each other around a cable.

Figure 6:
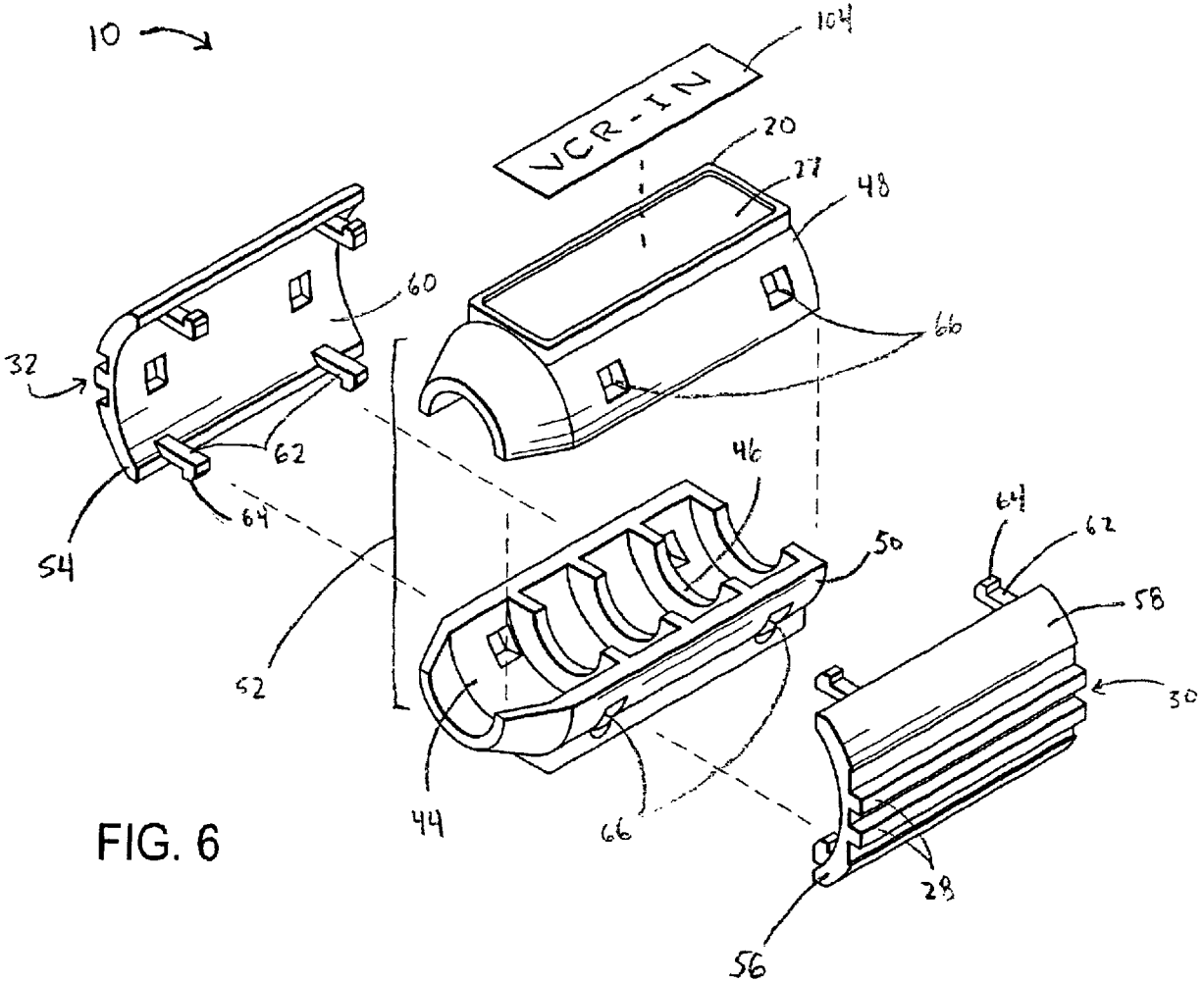
FIG. 6 is an exploded, isometric view of the sliding device of FIG. 2.

FIG. 6 shows an exploded view of a sliding device 10 as assembled from multiple, user-separable component parts. In this embodiment, a label-receiving piece 48 fits upon a corresponding mating piece 50, to form a core 52 that encloses an interconnect cable (not shown). Preferably, the label-receiving piece and the corresponding mating piece are both substantially semi-cylindrical in shape, as shown in FIG. 6, although other shapes are consistent with the goals of this invention.

A first reinforcing panel 54 and a second reinforcing panel 56 each include a convex exterior side 58 and a concave interior side 60. Exterior side 58 features ridges 28 in either a clip arrangement, indicated at 30, or a flange arrangement, indicated at 32. Interior side 60 includes a plurality of inwardly extending prongs 62, each of which terminates in a tab 64. Tab 64 extends perpendicularly from prong 62, oriented away from the axis of curvature of concave interior side 60.

Label-receiving piece 48 and mating piece 50 both feature a plurality of openings 66. Each opening 66 corresponds in position and size to each prong 62, such that prong 62 fits through opening 66.

To engage the sliding device on an interconnect cable, a user first encloses the cable between label-receiving piece 48 and corresponding mating piece 50, forming core 52. Next, the user operably interconnects label-receiving piece 48 to mating piece 50 by attaching first reinforcing panel 54 in the following manner. Prongs 62 are aligned with openings 66, and finger pressure is applied to push first reinforcing panel 54 against core 52 so that prongs 62 are forced through openings 66. Each tab 64 is positioned on interior side 60 such that when tab 64 engages opening 66, prong 62 is slightly distended towards the center of interior side 60, to allow tab 64 to fit through opening 66. When tab 64 has been inserted properly through opening 66, prong 62 snaps back to its original alignment, and tab 64 rests against interior wall 44, securing first panel 54 against core 52. In a similar manner, second reinforcing panel 56 is attached to the opposite side of core 52, completing the assembly of sliding device 10. Alternative methods that operably interconnect label-receiving piece 48 to mating piece 50 with reinforcing panels are also consistent with this invention.

Label-receiving piece 48 and mating piece 50 both feature flat area 20. Further, label-receiving piece 48 may include recessed area 27, as described above. If desired, the user may apply label 104 to recessed area 27 to identify cable usage. In fact, both pieces may bear user-applied indicators, to allow a cable to be identified more easily.

As mentioned, an advantage of this embodiment of the invention is that a composite sliding device may be affixed to an interconnect cable in use, without first disconnecting the cable. Another advantage is that the user may change the configuration of a sliding device by assembling the device with two flange-side reinforcing panels, two clip-side reinforcing panels, or with either of two possible flange-side/clip-side orientations. This versatility allows a user to assemble sliding devices such that two sliding devices indicating the same direction may be connected together as easily as two sliding devices indicating opposite directions, for example, as shown in FIG. 1 by sliding device 10*a* and adjacent sliding device 10*b*.

Figure 7:
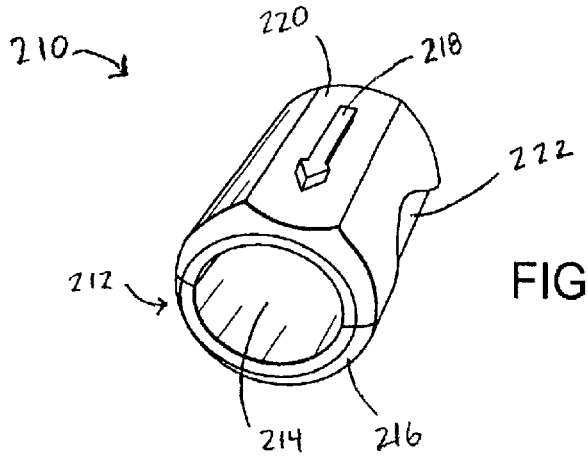
FIG. 7 is a perspective view of an alternative embodiment of a sliding device according to the present invention.
Figure 8:
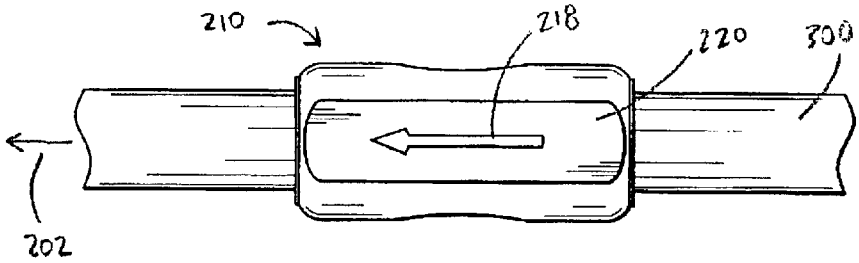
FIG. 8 is a top view of the sliding device of FIG. 7, depicting the device in position on an interconnect cable.
Figure 9:
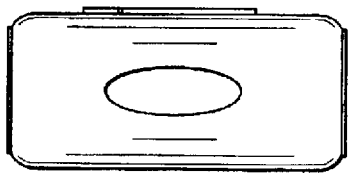
FIG. 9 is a side view of the sliding device of FIG. 8.

FIG. 7 shows a sliding device 210 according to an alternative embodiment of this invention. Sliding device 210 includes a body 212, which defines a hollow passageway 214 and an exterior 216. Hollow passageway 214 accommodates an interconnect cable. As shown in FIG. 8, sliding device 210 may be secured movably on an interconnect cable, indicated at 300.

Exterior 216 includes a directional indicator 218, positioned on a flat area 220. As discussed previously, directional indicator 218 may be used to indicate direction of signal flow 202 within interconnect cable 300, or alternately may indicate a direction from output to input or cable direction according to the user. As shown in FIGS. 7 and 8, directional indicator 218 is an embossed directional signal in the shape of an arrow, although other directional signals could be used. An advantage of an embossed directional signal is that a user may be able to discern, solely by sense of touch, which direction is indicated by sliding device 210.

Figure 10:
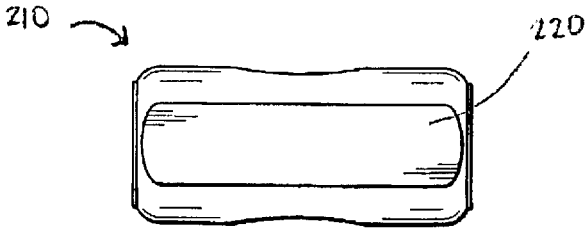
FIG. 10 is a bottom view of an opposite side of the sliding device of FIG. 8.

Instead of a directional indicator, flat area 220 alternatively may accommodate a user-applied identifier to designate cable usage. FIG. 10 shows sliding device 210 with flat area 220, without a directional indicator. Alternatively, sliding device 210 may feature more than one flat area, one of which may bear a directional indicator, and the other of which may accommodate a user-applied identifier either by application of the identifier directly to the flat area, or by including a recessed area in the flat area.

Sliding device 210 features side indentations 222, which form a useful surface upon which to grip sliding device 210, for instance between thumb and forefinger, to slide it along the cable.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and subcombinations of the various elements, features, functions, and/or properties disclosed herein. No single feature, function, element, or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to any earlier claims, also are regarded as included within the subject matter of the invention.

What is claimed is:

1. A sliding device for use on a cable, the device comprising:

an exterior, including:

a directional indicator to indicate a user-defined cable orientation;

a predefined labeling area for receiving a user-applied identifier; and an interior passageway for receiving a cable, such that the sliding device is selectively movable along the cable.

2. The sliding device of claim 1, wherein the device is molded in one piece.

3. The sliding device of claim 1, wherein the device is assembled from at least two user-separable pieces so that the device may be removably applied to a cable that is in use.

4. The sliding device of claim 3 further comprising at least one reinforcing piece that operably interconnects the user-separable pieces.

5. The sliding device of claim 3 wherein the at least two user-separable pieces are substantially semi-cylindrical.

6. The sliding device of claim 4 wherein the at least one reinforcing piece includes a portion of an interlock mechanism that may interlock with another portion of an interlock mechanism of another sliding device.

7. The sliding device of claim 6 further comprising an additional reinforcing piece.

8. The sliding device of claim 7, wherein the at least one reinforcing piece and the additional reinforcing piece are substantially semi-cylindrical.

9. The sliding device of claim 8, wherein the at least two user-separable pieces are substantially semi-cylindrical.

10. The sliding device of claim 1, wherein the exterior further includes at least one indentation forming a gripping area.

11. The sliding device of claim 1, wherein the directional indicator includes a tapered end.

12. The sliding device of claim 1, wherein the directional indicator includes an embossed directional signal.

13. The sliding device of claim 12, wherein the embossed directional signal is an arrow.

14. The sliding device of claim 1, wherein the interior passageway includes a restraint to increase a frictional grip of the sliding device on a cable.

15. The sliding device of claim 14, wherein the interior restraint includes on a selectively removable O-ring.

16. The sliding device of claim 1, wherein the exterior further includes a portion of an interlock mechanism that may interlock with another portion of an interlock mechanism of another sliding device.

17. A pair of sliding devices for use on a cable, each device comprising:

an interior passageway for receiving a cable; and an exterior, including:

a directional indicator to indicate a user-defined cable orientation; and a portion of an interlock mechanism;

wherein the portion of an interlock mechanism of one of the devices may interlock with the portion of an interlock mechanism of the other of the devices.

18. The sliding devices of claim 17, wherein at least one of the devices, is molded in one piece.

19. The sliding devices of claim 17, wherein at least one device is assembled from at least two user-separable pieces so that the at least one device may be removably applied to a cable that is in use.

20. The sliding devices of claim 19, wherein the at least one of device further comprises at least one reinforcing piece that operably interconnects the user-separable pieces.

21. The sliding devices of claim 20, wherein the at least one of device further comprises an additional reinforcing piece.

22. The sliding devices of claim 21, wherein the at least one reinforcing piece and the additional reinforcing piece are substantially semi-cylindrical.

23. The sliding devices of claim 22, wherein the at least two user-separable pieces are substantially semi-cylindrical.

24. The sliding devices of claim 17, wherein the at least two user-separable pieces are substantially semi-cylindrical.

25. The sliding devices of claim 17, wherein the exterior of at least one of the devices further includes at least one indentation forming a gripping area.

26. The sliding devices of claim 17, wherein the directional indicator of at least one of the devices further comprises a tapered end.

27. The sliding devices of claim 17, wherein the directional indicator of at least one of the devices further comprises an embossed direction signal.

28. The sliding devices of claim 27, wherein the embossed directional signal is an arrow.

29. The sliding devices of claim 17, wherein the interior passageway of at least one of the devices includes a restraint to increase a frictional grip of the sliding device on a cable.

30. The sliding devices of claim 29, wherein the interior restraint includes an O-ring.

31. A device for use on a cable, the device comprising:

a directional indicator to indicate a user-identified cable orientation;

a predefined labeling area for receiving a user-applied identifier; and an interior passageway for receiving a cable;

wherein the device is assembled from at least two user-separable pieces and at least one reinforcing piece that operably interconnects the user-separable pieces, so that the device may be applied to a cable that is in use; and wherein the at least one reinforcing piece includes a portion of an interlock mechanism that may interlock with another portion of an interlock mechanism of another sliding device.

32. The sliding device of claim 31, further comprising an additional reinforcing piece.

33. The sliding device of claim 32 wherein the at least one reinforcing piece and the additional reinforcing piece are substantially semi-cylindrical.

34. The sliding device of claim 33 wherein the at least two user-separable pieces are substantially semi-cylindrical.

35. A pair of devices for use on a cable, each device comprising:

an interior passageway for receiving a cable; and a portion of an interlock mechanism;

wherein the portion of an interlock mechanism of one of the devices may interlock with the portion of an interlock mechanism of the other of the devices;

wherein at least one device is assembled from at least two user-separable pieces and at least one reinforcing piece that operably interconnects the user-separable pieces, so that the device may be applied to a cable that is in use.

36. The sliding devices of claim 35, wherein the at least one device assembled from at least two user-separable pieces and at least one reinforcing piece further comprises an additional reinforcing piece.

37. The sliding devices of claim 35, wherein the at least one reinforcing piece and the additional reinforcing piece are substantially semi-cylindrical.

38. The sliding devices of claim 37 wherein the at least two user-separable pieces are substantially semi-cylindrical.

39. A kit for labeling a cable, the kit comprising:

a label-receiving piece shaped to at least partially surround a cable; and a matins piece shaped to at least partially surround a cable and to mate with the label-receiving piece;

a clip-side reinforcing piece that operably interconnects the label-receiving piece and the, mating piece and that includes a clip; and a flange-side reinforcing piece that operably interconnects the label-receiving piece and the mating piece and that includes a flange that may interlock with the din of the clip-side reinforcing piece;

wherein at least one of the label-receiving piece and the mating piece includes a directional indicator to indicate a user-identified cable orientation.

* * * * *